United States Patent [19]

Price et al.

[11] 4,375,990

[45] Mar. 8, 1983

[54] SUGAR CENTRIFUGE BASKET ASSEMBLY AND METHOD OF ASSEMBLING SAME

[75] Inventors: Frank B. Price, Jefferson County; Mathieu J. Vertenstein, Denver, both of Colo.

[73] Assignee: Silver Engineering Works, Inc., Denver, Colo.

[21] Appl. No.: 204,850

[22] Filed: Nov. 7, 1980

[51] Int. Cl.[3] ..... B04B 1/00; B04B 3/00; C13F 1/06

[52] U.S. Cl. ..... 127/19; 210/380.1; 228/101; 228/165; 228/168; 494/43

[58] Field of Search ..... 127/19; 228/101, 165, 228/168; 210/380.1; 233/1 R, 27

[56] References Cited

U.S. PATENT DOCUMENTS

| | | | |
|---|---|---|---|
| 2,709,295 | 5/1955 | Chyle | 228/168 X |
| 2,753,622 | 7/1956 | Bieber | 228/165 X |
| 3,204,083 | 8/1965 | Fromm | 228/165 X |
| 4,017,022 | 4/1977 | Fiedler | 127/19 X |
| 4,097,303 | 6/1978 | Korsch | 127/19 |
| 4,158,573 | 6/1979 | Hentschel | 127/19 |
| 4,200,218 | 4/1980 | Koehler | 228/165 |

*Primary Examiner*—Sidney Marantz

*Attorney, Agent, or Firm*—Edwin L. Spangler, Jr.

[57] ABSTRACT

An improved basket assembly and method of making same of the type designed for use in a sugar centrifuge that includes an annular mounting flange containing an upwardly-flared frustoconical seat and an open-bottomed conical element adapted to mate in assembled relation with the aforementioned frustoconical flange seat. The apparatus is characterized by shaping the opposed surfaces at the lower end of the cone and base of the seat so as to cooperate with one another in assembled relation to define an upwardly-opening and inwardly-flared continuous annular groove for the reception of a weld. The apparatus also includes a circumferentially-spaced series of apertures in the wall of the cone opening onto the conical surface of the seat when assembled to receive a corresponding number of plug welds. The method of assembling the cone and flange assembly includes the unique feature of taking advantage of the shrinking action of the continuous annular weld to draw the cone down into its seat thus defining a shrink fit therebetween and maintaining the relationship thus established upon relaxation of the external forces holding the parts in assembled relation by placing distortion-free plug welds within the cone apertures.

10 Claims, 3 Drawing Figures

SUGAR CENTRIFUGE BASKET ASSEMBLY AND METHOD OF ASSEMBLING SAME

Figure 1:
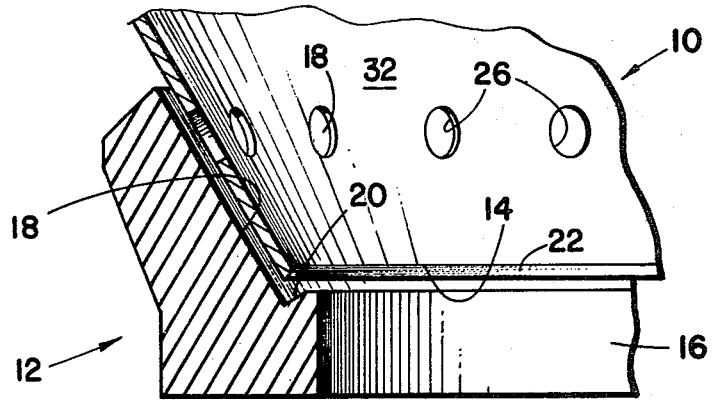

In U.S. Pat. No. 4,017,022, a basket subassembly for use in sugar centrifuges and the like is shown wherein a hollow conical element manufactured by a conventional spinning technique is adhesively as well as mechanically fastened within the mating frustoconical seat of an annular cone-mounting flange. This patent, among other things, reveals some of the problems associated with fabricating the cone and, more particularly, the fastening therof to the flange in a manner such that the assembly remains essentially vibration-free when rotated at high speeds. In describing these problem areas, mention is made of the fact that welding or soldering of the cone to its flange are unsatisfactory solutions due to the stresses and strains introduced into the assembly which result in the very kind of distortions and conditions of imbalance that must be avoided.

Contrary to the teaching of the aforementioned patent, it has now been found in accordance with the teaching of the instant invention that a welded assembly can, in fact, be produced which is simpler, cheaper and far superior to any other yet devised including the patented mechano-slow-drying adhesive one. More specifically, by starting with a suitable accurately fabricated thin-walled cone element and shaping the small end thereof so as to provide an annular beveled edge which will cooperate in assembled relation with the opposed surface of the frustoconical seat in the annular mounting flange to define an upwardly and inwardly divergent weldment groove, a continuous weld can be employed to join these two elements together securely and permanently without distortion. In addition, and unexpectedly, this same weld functions as it shrinks to draw and wedge the mating surfaces of the cone, and flange into tighter continuous annular face-to-face contact than it has heretofore been possible to achieve by any known technique. As thus assembled, the final connection is made by filling a circumferentially-spaced series of drilled apertures near the base of the cone with plug welds attaching the latter in a distortion-free manner to the conical surface of the flange seat exposed therethrough.

It is, therefore, the principal object of the present invention to provide a novel and improved sugar centrifuge basket assembly employing welded connections exclusively.

A second objective is the provision of an improved method for making the assembly which includes holding the elements in assembled relation while welding them together and then using the shrinking action of the weld thus made to form an even tighter connection therebetween preparatory to maintaining the aforesaid condition with other distortion-free welds.

Another object is to provide an assembly of the type aforementioned which can be fabricated faster and more easily than comparable units using cast cones.

Still another objective is the provision of a shrunk-fit assembly that requires no further adjustment onced complete.

An additional object is that of providing a method of assembling the assembly which requires only minimal machining.

Further objects are to provide an assembly of the character described which is versatile, cost effective, readily adaptable to various types and sizes of sugar centrifuges and one that requires the expenditure of less energy to operate.

Figure 2:
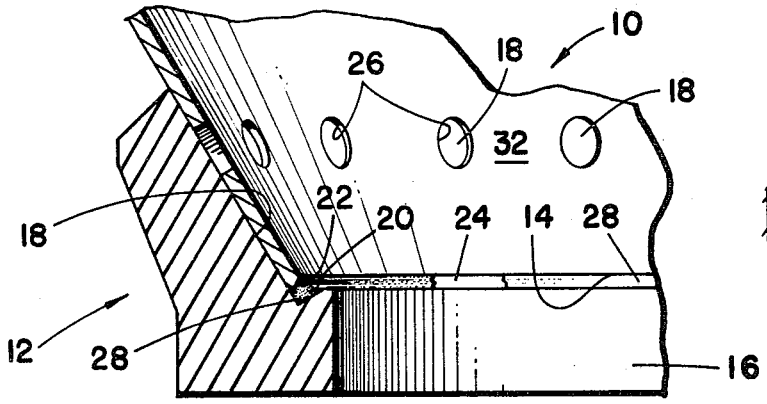
Figure 3:
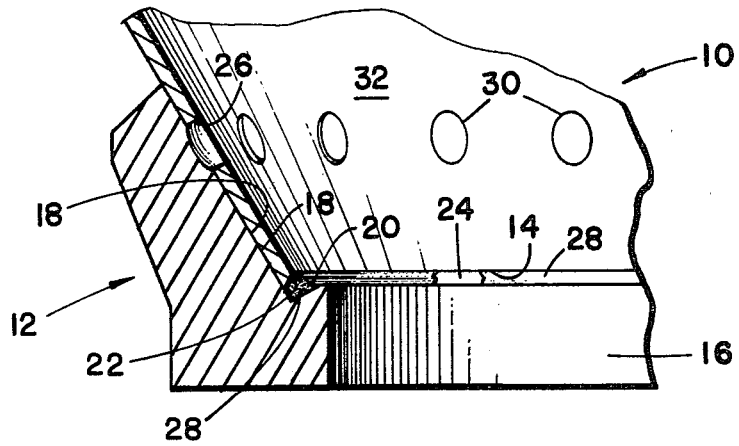

Other objects will be in part apparent and in part pointed out specifically hereinafter in connection with the description of the drawings that follows, and in which:

FIG. 1 is a fragmentary diametrical section showing the cone element in position to move into seated relation within the frustoconical seat of its mounting flange;

FIG. 2 is a fragmentary section like FIG. 1 and to the same scale but differing therefrom in that the cone element is seated and welded to the mounting flange by means of the continuous annular weld, a section of the latter having been broken away to reveal the weld groove; and, FIG. 3 is still another fragmentary section like those of FIGS. 1 and 2 but showing the completed assembly including the plug welds that maintain the elements in fully seated shrunk-fit relation, portions of the annular weld having once again been broken away to expose the weld groove.

Referring next to the drawings for a detailed description of the present invention, reference numeral 10 has been chosen to broadly designate the cone element of the basket assembly forming the subject matter hereof while numeral 12 similarly connotes the annular flange in which the small end 14 of the cone is seated and secured in a manner to be described presently. Annular mounting flange 12 is a cast element containing a central opening 16 bordered by an upwardly-flared frustoconical seat 18 which is precisely machined to close tolerances. Separating the seat 18 from the central opening 16 is an annular ledge 20 which slopes outwardly and downwardly more or less perpendicular to the frustoconical seating surface in the particular form shown. This ledge has particular significance in the present invention because it cooperates with the beveled edge 22 on the lower end of the cone to define a continuous annular upwardly and inwardly-flared weldment groove 24 when the cone is assembled in seated relation within its seat.

Spaced above the lower end 14 of the cone but at a distance therefrom less than the height of seat 18 are drilled a circumferentially-spaced series of round apertures 26 opening onto the aforesaid frustoconical seating surface when elements 10 and 12 of the assembly are in the assembled relation shown in FIGS. 2 and 3. As will be explained presently, weldment groove 24 receives a weld 28 (FIGS. 2 and 3) while apertures 26 receive plug welds 30 (FIG. 3).

Now, with certain state-of-the-art techniques presently available, it is possible to fabricate cone element 10 so as to produce very accurate conical surfaces, both inside and out, along with an integrally-formed annular rim (not shown) bordering the top edge thereof, all without resorting to expensive and time-consuming machining operations. The cone element prior to being drilled, also has a bottom in it (not shown) which upon being cut free leaves the beveled edge 22. Savings of upwardly of 70% can be realized in the fabrication of a basket assembly by avoiding costly machining operations heretofore required to finish the cone to the degree required for high speed rotation of the type encountered in a sugar centrifuge. As will be explained presently, only light finish machining of the lower part of the cone is required as opposed to the current practice of casting the cone and having to machine both surfaces thereof from bottom to top.

Specifically referring to FIG. 1 for the moment, once the cone is fabricated, the holes 26 drilled therein and the bottom removed to provide beveled edge 22, it is placed small-end-down into frustoconical seat 18 which has been pre-machined to receive same. Then, mated elements 10 and 12 are pressed and held in assembled relation under a pressure of approximately 80 tons of thereabouts preparatory to being welded together into assembled relation. Prior to making the welded connection 28 it has been determined that the clearance between the mating conical surfaces of the seat and cone is of the order of 0.0015 inches and less.

Next, looking at FIG. 2, it will be seen that with elements 10 and 12 thus pressed into assembled relation and while so held, weld 28 is made. It has been found that weld 28 introduces no significant distortion in the cone element while, at the same time, providing the additional advantage of drawing the cone down into its seat with a wedging action effective to produce a shrink fit much tighter than has heretofore been possible to achieve through the use of other assembly techniques. The resulting fit is so tight, in fact, that the portion of the cone seated within the mounting flange seat not infrequently shows a reduction in diameter of as much as 1/32 inch.

Having completed the shrunk-fit assembly, the next step in the operation is that of making plug welds 30 as shown in FIG. 3. These plug welds, like weld 28, result in essentially zero distortions of either the cone or its mounting flange while, at the same time, cooperating with weld 28 to produce a permanent and secure connection therebetween. Once thus assembled, the only remaining operation is a light finish machining of the lower end of the inside cone surface to smooth same and produce a purely conical surface. In the upper reaches of the cone, this consists primarily of eliminating any unevenness resulting from the fabrication operation. Along the plug weld line, of course, it means removing the rough and uneven exposed surfaces of the welds as indicated by phantom lines in FIG. 3. All along the base of the cone where it is seated within the flange, some metal has to be machined from the inside surface as a result of the typical convex surface of the weld. Even so, probably a 1/64 of an inch or less of metal need be machined away to restore the true conical inside surface 32.

When thus constructed and assembled, the resulting basket assembly is far superior in many ways to comparable assemblies made in accordance with conventional techniques, not the least of which is the cost factor already mentioned. In addition, however, the assemblies are interchangeable from one centrifuge to another. The mounting flanges are a simple and inexpensive part that require only minimal machining, therefore, they can be made up in advancve and inventoried. Then, by using modern forming techniques for fabrication of the thin-walled cone, what used to take months to do because of the time involved in finishing a casting can now be accomplished in just a few days. The considerably thinner and lighter weight assembly reduces electric motor investment costs also because it is easier to start due to its substantially reduced moment of inertia.

What is claimed is:

1. The combination in a basket assembly for use in a sugar centrifuge of a hollow upwradly-flared open-bottomed frustoconical member, an annular mounting flange for said frustoconical member having a frustoconical seat shaped to receive same and a first weld joining said frustoconical member and its mounting flange together in assembled relation, said frustoconical member and flange having opposed weld-receiving surfaces spaced apart to leave a portion of said seat exposed therebetween in assembled relation, said weld-receiving surfaces cooperating with one another and said exposed portion of the seat to define an inwardly-opening continuous annular groove for the reception of the weld, and said first weld when in place within the groove being effective to draw the frustoconical member into its seat so as to maintain a shrink-fit relation between it and its mounting flange.

2. The combination as set forth in claim 1 wherein the open-bottom of said frustoconical member is bordered by a continuous relatively broad blunted edge forming one of said opposed groove-defining surfaces, and wherein the frustoconical seat in the mounting flange is bordered at the lower end thereof by an inwardly-directed ledge forming the other of said opposed groove-defining surfaces.

3. The combination as set forth in claim 1 wherein said groove is inwardly-flared.

4. The combination as set forth in claim 1 wherein said groove is inwardly and upwardly-flared.

5. The combination of claim 1 wherein the frustroconical member includes a series of circumferentially-shaped apertures positioned to open onto the frustoconical mounting flange seat is assembled relation, and wherein a corresponding series of plug welds welded to the flange seat within said apertures cooperate with one another and with said first weld to maintain said shrink-fit relation.

6. The combination of claim 5 wherein the apertures are arranged is substantially equiangularly-spaced relation.

7. The method for fastening the upwardly-flared open-bottomed frustoconical element of a sugar centrifuge basket assembly within the frustoconical seat shaped to receive same in the mounting flange therefor which comprises the steps of: forming spaced annular weld-receiving surfaces bordering the open bottom of the frustoconical member and at the base of the mounting flange seat exposing a portion of the latter therebetween, and filling the annular groove thus formed with a weld effective when it shrinks to draw said frustoconical member into its seat with a wedging action.

8. The method of claim 7 wherein the opposed weld-receiving surfaces are shaped to cooperate and define an inwardly-divergent groove.

9. The method of claim 7 which includes the step of forming a circumferential series of spaced apertures in the frustoconical element positioned to open onto the frustoconical seat of the mounting flange when said element is seated therein, and filling said apertures with plug welds when thus seated to maintain the shrink-fit wedged relation therebetween.

10. The method as set forth in claim 9 which includes the step of machining the lower inside surface of the frustoconical element following completion of the assembly to restore its conical shape.

* * * * *